United States Patent [19]

Parker et al.

[11] Patent Number: 4,487,676

[45] Date of Patent: Dec. 11, 1984

[54] ANTICORROSION ANODE WITH MAGNETIC HOLDDOWN

[75] Inventors: Robert Parker, Alamo; James P. Reed, Mountain View, both of Calif.

[73] Assignee: Raychem Corporation, Menlo Park, Calif.

[21] Appl. No.: 296,767

[22] Filed: Aug. 27, 1981

[51] Int. Cl.[3] ..... C23F 13/00; C25B 11/00

[52] U.S. Cl. ..... 204/196; 204/248; 204/286; 204/290 R; 204/297 M

[58] Field of Search ..... 204/196–197, 204/297 M, 248, 286, 290 R; 248/206 A

[56] References Cited

U.S. PATENT DOCUMENTS

| | | | |
|---|---|---|---|
| 50,773 | 10/1865 | Parry | 204/196 X |
| 2,760,636 | 8/1956 | Johnson | 204/197 X |
| 3,195,022 | 7/1965 | Staver | 248/206 A X |
| 3,262,479 | 7/1966 | Leguillon | 248/206 A X |
| 3,657,084 | 4/1972 | Beer et al. | 204/197 X |
| 3,772,179 | 11/1973 | Beer | 204/297 M X |
| 3,893,903 | 7/1975 | Lindholm | 204/297 M X |
| 4,287,676 | 9/1981 | Weinhaus | 248/206 A X |

FOREIGN PATENT DOCUMENTS

| | | | |
|---|---|---|---|
| 37-2159 | 5/1962 | Japan | 204/196 |

*Primary Examiner*—Donald R. Valentine

*Attorney, Agent, or Firm*—Timothy H. P. Richardson

[57] ABSTRACT

An anode for the internal protection of hollow corrodible magnetically receptive metallic substrates is attached to a flexible permanent magnet along its length, thereby enabling it to hold to the substrate. This prevents abrasion and electrical short-circuiting of the anode when turbulent flow would cause an unattached anode to abrasively contact the substrate. A method of inserting the anode into a substrate, such as a pipe, is also described.

10 Claims, 7 Drawing Figures

ANTICORROSION ANODE WITH MAGNETIC HOLDDOWN

BACKGROUND OF THE INVENTION

This invention relates to an anode for the internal protection of hollow corrodible metallic substrates wherein the anode incorporates a magnetic holddown means.

Metallic anodes for the internal protection of hollow corrodible substrates are known. When the anode is not to be sacrificial, it may be plated with a thin layer of a precious metal such as platinum. Such an anode is often placed inside a porous jacket to protect the thin plating layer of precious metal from damage, since any damage could result in exposure of the anode base material followed by corrosion, thereby leading to failure of the anode.

In copending and commonly assigned U.S. application Ser. No. 272,854, filed June 12, 1981 now abandoned and entitled "Corrosion Protection System", the disclosure of which is incorporated herein by reference, there is disclosed a flexible conductive polymeric anode suitable for the internal protection of hollow corrodible metallic substrates by means of impressed current protection. Such an anode has the advantages over conventional anodes of flexibility and electrochemical stability.

However, an internal anode is subject to abrasion against the internal surface of the substrate, such as a pipe in which it is placed, should there be flow, especially turbulent flow, of the fluid passing through. Also, though most pipes, tanks, etc. which are used for the conveyance and storage of corrosive fluids are internally coated with a non-conductive, corrosion-resistant layer (such as an epoxy), bare metal may be exposed and there therefore is the possibility of a short-circuit between the anode and substrate should they come into contact, leading to the loss of corrosion protection.

In the '854 application, it was proposed to adhere the conductive polymeric anode to the substrate with an adhesive, and/or to protect it with a porous jacket, such as a braid.

The use of an adhesive is sometimes unsatisfactory both because the anode may not adhere well to e.g. a dirty substrate, and because installation of an adhesive-coated anode will be difficult due to adhesion at undesired locations.

Protecting the anode by means of a porous jacket is a useful technique, but abrasion can still occur when the jacket is damaged.

It is therefore desirable to develop a method for preventing the anode of a corrosion protection system from (a) abrasion against the substrate, and (b) accidential electrical contact with the substrate during use. The anode should also be capable of facile installation.

DESCRIPTION OF THE INVENTION

Summary of the Invention

We have discovered that the use of a flexible permanent magnet material as a holddown for a corrosion protection anode offers a simple and reliable method for protecting the anode from unwanted contact with the substrate (causing abrasion and/or short-circuiting).

DETAILED DESCRIPTION OF THE PREFERRED EMBODIMENTS

The anode assembly of this invention comprises a flexible elongate anode, e.g. of metal or conductive polymer, attached to a strip of flexible electrically non-conductive permanent magnet material.

Figure 1:
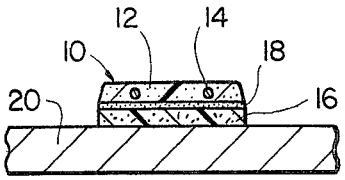
FIG. 1 shows, a cross-section, a first embodiment of a an anode assembly of this invention.

FIG. 1 shows, in cross-section, a first embodiment of an anode assembly of this invention. The anode shown generally at 10 comprises a conductive polymeric material 12 within which are embedded electrical lead wires 14. This polymeric anode is attached to a flexible electrically non-conductive permanent magnet material 16 by an adhesive 18, at at least a plurality of points.

Because of the adhesion of the magnet material 16 to a substrate 20, which is generally the inside of the pipe or tank to be protected, the anode is held in substantially stationary close proximity to the substrate and is prevented from being abraded by the substrate when turbulent flow through the substrate would otherwise cause an unattached anode to oscillate.

Of course, the magnet material will only hold to magnetically receptive substrates, such as ferrous metals. Since these metals, particularly steels, are used for the majority of industrial piping and containers, and since these metals are also the most subject to corrosion, the usage limitations to magnetically receptive substrates is not a great disadvantage.

The magnet material used for this invention is desirably of approximately the same flexibility as the anode, so that it does not impose significant constraints on installation. Frequently, it may be necessary to install anodes into an existing system, where access is limited by the need for minimum disassembly of, or damage to, the system. A flexible anode-holddown combination could be inserted through a comparatively small port cut into a pipe, rather than requiring large flanges or straight-run access.

Chemically, the magnet material should desirably be resistant to the environment it will encounter during service. For this reason, metallic magnet material is generally not preferred, and ferrites or similar materials are likely to be more suitable.

While it is possible to use a plurality of separate magnets attached along the anode, this method has the disadvantage that the anode between the magnets may move in response to currents in the flow of fluid within the substrate, and it is preferred that an elongate magnet material be used.

Bearing in mind these above factors, it is therefore desirable to use a magnet material consisting of particles of a ferrite or similar permanent magnet material dispersed in a chemically resistant polymer, such as a polyolefin, rubber, etc. Such materials are available from various sources, e.g. Plastiform brand magnet from 3M (which comprises oriented barium ferrite particles in a vulcanized nitrile rubber). An additional advantage of these materials is that they generally have a high resistivity, e.g. $10^{10}$ ohm-cm, and thus provided an electrically insulated standoff for the anode. Such magnetic materials, though customarily available in strip or sheet form, are capable of preparation by extrusion into more complex shapes, such as are exemplified in FIGS. 2 and 3.

The size of the magnet material required will depend on factors such as the holding force of the magnet, the cross-sectional area of the anode, the substrate, and the nature and flow of the fluid in the substrate. In general, it will be possible to increase the size of the magnet to produce the requisite force, through a low profile for the installed anode may be desirable if the pipe is to be cleaned out e.g. by "pigging".

Figure 2:
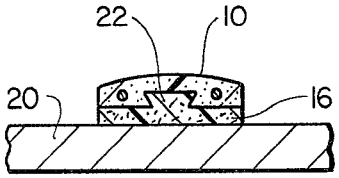
FIGS. 2 through 6 depict alternative embodiments.
Figure 3:
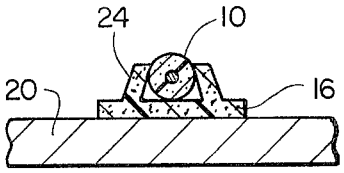

FIGS. 2 and 3 depict in cross-section two exemplary alternative methods of attaching the polymeric anode to the magnet material. In FIG. 2, the anode 10 has a dovetail groove and the magnet a corresponding key, shown jointly as 22. The reverse arrangement is also possible, with the magnet material having a groove and the polymeric anode, the key. In FIG. 3, the magnet 16 has protrusions 24 which partially encapsulate and hold the anode 10. This arrangment is particularly suitable for an anode of generally circular cross-section.

Figure 4:
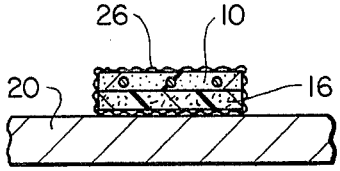

FIG. 4 shows another exemplary method of attachment. Here, the anode 10 and magnet material material 16 are held within an electrically non-conductive wrapping, shown as a braid 26. While a braid, or similar porous material, could be used the whole length of the anode (since the surface of the anode will retain access to the fluid in the substrate via the pores), if a non-porous material is used, it may be placed around the anode and magnet material at a plurality of discontinuous regions. A suitable technique, in this case, might be to cut sections of heat-shrinkable tubing, slide them over the magnet and anode, and shrink them into place at appropriate intervals, e.g. every 50 cm. If an encapsulating technique is used, care must be taken that the magnet will still exert an adequate grip on the substrate, and thus the braid, etc. should preferably be thin.

Figure 5:
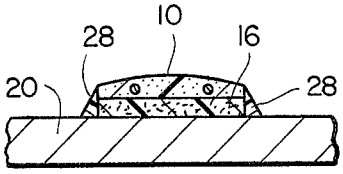

A possible problem with a magnetic holddown is that magnetic particles from the fluid or corrosion products from the substrate may attach themselves to the exposed surfaces of the magnet, e.g. to the edges. If these products are sufficiently conductive, e.g. if they are oxidized metal flakes, etc. from a corroding substrate, a conductive leak path may be formed between the anode and the substrate. To avoid this magnetic sludge buildup, FIG. 5 shows two non-magnetic polymeric wedges 28, one on either edge of the magnetic material. These wedges provide a sufficient spacing from the edges of the magnet material that magnetic "sludge" will not adhere.

While an adhesive layer 18 was shown in FIG. 1 only, the use of an adhesive to form a bond between the magnetic material and the anode 10 (and the wedges 28), as in FIGS. 2 through 5, may well be desirable, and such is within the scope of the invention.

Figure 6:
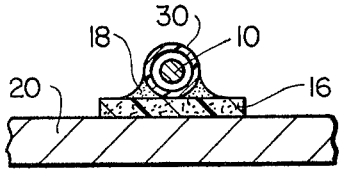

FIG. 6 shows yet another exemplary method of attachment. Here the anode 10 (shown as a solid metallic anode) lies within a porous jacket or tube 30, and this jacket is attached by adhesive 18 to the magnet 16 in the manner previously described.

While this embodiment of FIG. 6 has been shown with a metallic anode and FIGS. 1–5 with a conductive polymeric anode, no limitation as to the type of anode which may be attached by any particular method is intended.

Figure 7:
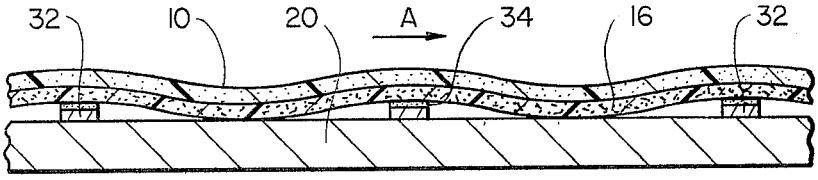
FIG. 7 depicts, in longitudinal section, an anode assembly of this invention during installation.

As the magnet material, when in full contact with the substrate, offers a considerable resistance to movement in either a longitudinal or transverse direction, it is necessary to separate it from the substrate during installation. FIG. 7 depicts one exemplary technique for this. Small degradable standoffs 32 are attached by a degradable adhesive 34 to the underside of the magnet material 16 (the side remote from the anode 10). During insertion, as the magnet/ anode combination is pulled along the substrate, as indicated by the arrow A, the standoffs prevent the magnet from gripping the substrate, so that insertion is facile. When fluid is admitted to the substrate after insertion, the adhesive and standoffs degrade allowing the magnet to come into intimate contact with the substrate. For example, if the fluid is an aqueous solution, the standoffs may be of cardboard and the adhesive used be water-soluble. The intervals between the standoffs can readily be determined by experimentation, and a spacing of about 50 cm is generally satisfactory.

Alternative installation techniques which prevent or minimize contact of the magnetic material with the substrate until desired are readily conceivable. For example, the magnet/anode combination may be placed inside a flexible tube and installed in that way. When the product is in place, the tube is removed, and the magnet material adheres to the substrate. If the tube used for insertion is sufficiently porous, it may not be necessary to remove it, and it is feasible to wait until the tube degrades by physical or chemical action in use, at which point the magnet/anode combination will adhere to the substrate with which it comes into contact. In this instance, the magnet is effectively a backup method.

Retreival may be accomplished most easily by a technique which breaks the magnetic contact with the substrate, such as by peeling back the combination from one end.

Having described our invention with respect to certain preferred embodiments, it is understood that our invention is not restricted by those embodiments, but only by the claims which follow.

We claim:

1. A flexible anode assembly for the internal protection of hollow corrodible metallic substrates, which assembly comprises:

(a) a flexible elongate anode selected from the group consisting of:

(1) a conductive polymeric anode comprising at least one electrical lead wire surrounded by and in contact with a conductive polymeric material, and (2) a metallic anode comprising a precious metal plating; and (b) a flexible electrically non-conductive permanent magnet material attached to said anode at at least a plurality of joints along its length; whereby said anode may be held in proximity to, but electrically insulated from, said substrate.

2. The anode assembly of claim 1, wherein said anode and said magnet material are attached to each other by an adhesive bonding layer between them.

3. The anode assembly of claim 1, wherein said anode and said magnet material are mechanically attached to each other.

4. The anode assembly of claim 1, wherein said anode and said magnet material are placed in a common jacket.

5. The anode assembly of claim 1, wherein said anode is emplaced in a porous jacket which is attached to said magnet material.

6. The anode assembly of claim 1, which additionally comprises non-magnetic material attached to said magnet material in such a manner that only a single surface of said magnet material is exposed.

7. The anode assembly of claim 1, wherein said anode is a conductive polymeric anode comprising at least one electrical lead wire surrounded by and in electrical contact with a conductive polymeric material.

8. The anode assembly of claim 1, wherein said anode is a metallic anode comprising a precious metal plating.

9. A method for inserting the anode assembly of claim 1 into a hollow corrodible metallic substrate which comprises attaching degradable non-magnetic standoffs to at least a plurality of points along that side of said magnet material which is disposed toward said substrate, inserting the anode assembly into the substrate, and allowing the standoffs to degrade such that said magnet material adheres to said substrate.

10. A method for locating a flexible elongate anode within a hollow corrodible metal substrate which comprises:

(a) attaching to said anode, at at least a plurality of points along its length, a flexible electrically non-conductive permanent magnet material;

(b) inserting said anode into the substrate; and (c) causing said magnet material to adhere to the substrate, whereby said anode is located in proximity to, but electrically insulated from, the substrate.

* * * * *